US007866949B2

(12) United States Patent
Bracken et al.

(10) Patent No.: US 7,866,949 B2
(45) Date of Patent: Jan. 11, 2011

(54) METHODS AND APPARATUS FOR FABRICATING A ROTOR FOR A STEAM TURBINE

(75) Inventors: Robert James Bracken, Niskayuna, NY (US); John Thomas Murphy, Niskayuna, NY (US); Clement Gazzillo, Schenectady, NY (US); John Cleland Lavash, Niskayuna, NY (US); Stephen Roger Swan, Ballston Lake, NY (US); Ronald Wayne Korzun, Clifton Park, NY (US); Jeffrey Robert Simkins, Rensselaer, NY (US)

(73) Assignee: General Electric Company, Schenectady, NY (US)

( * ) Notice: Subject to any disclaimer, the term of this patent is extended or adjusted under 35 U.S.C. 154(b) by 397 days.

(21) Appl. No.: 11/466,986

(22) Filed: Aug. 24, 2006

(65) Prior Publication Data

US 2008/0050226 A1 Feb. 28, 2008

(51) Int. Cl.
*F01D 5/16* (2006.01)

(52) U.S. Cl. ..... 416/198 R; 416/198 A; 415/199.5

(58) Field of Classification Search ..... 415/198.1, 415/199.5; 416/198 R, 198 A; 403/369; 285/412, 913, 914
See application file for complete search history.

(56) References Cited

U.S. PATENT DOCUMENTS 2,689,682 A * 9/1954 Boyd et al. ..... 416/194
3,059,901 A * 10/1962 Snow et al. ..... 415/134
4,915,581 A 4/1990 Groenendaal, Jr. et al.
5,033,936 A * 7/1991 Shinojima ..... 415/90
5,158,426 A * 10/1992 Casaro et al. ..... 415/52.1
5,222,863 A * 6/1993 Jones ..... 415/199.5
5,414,929 A * 5/1995 Floser et al. ..... 29/889.21
5,746,579 A 5/1998 Amos et al.
5,784,927 A 7/1998 Rao et al.
5,810,192 A * 9/1998 Cruz ..... 220/475
5,811,900 A 9/1998 Serdar, Jr. et al.
6,123,504 A 9/2000 Shiga et al.
6,224,341 B1 5/2001 Fricke
6,318,964 B1 * 11/2001 Yang ..... 416/185
6,322,323 B1 11/2001 Komiyama et al.
6,471,482 B2 10/2002 Montgomery et al.
6,814,543 B2 11/2004 Barb et al.
6,832,895 B2 * 12/2004 Yoshioka et al. ..... 416/183
2003/0063975 A1 * 4/2003 Horng et al. ..... 416/183
2003/0108420 A1 * 6/2003 Yoshioka et al. ..... 415/199.5

* cited by examiner

*Primary Examiner*—Ninh H Nguyen
*Assistant Examiner*—Aaron R Eastman
(74) *Attorney, Agent, or Firm*—Armstrong Teasdale LLP

(57) ABSTRACT

A method of fabricating a turbine rotor is provided. The method includes fabricating a plurality of substantially cylindrical disks. Fabricating each disk includes fabricating a substantially cylindrical body and extending a bore substantially concentrically through the body. The method also includes coupling at least two of the plurality of disks together to form a rotor having a bore extending axially therethrough.

20 Claims, 3 Drawing Sheets

METHODS AND APPARATUS FOR FABRICATING A ROTOR FOR A STEAM TURBINE

BACKGROUND OF THE INVENTION

This invention relates generally to steam turbines and, more particularly, to methods and systems for fabricating a rotor for a steam turbine.

At least some known rotors are fabricated as a single forging that includes rotor ends, bearing regions, packing regions, and a steampath section. Generally, the weight of such rotors causes the rotor to pass through a first critical speed during operation. Specifically, the first critical speed is equal to the square root of the rotor's stiffness over the rotor's weight. More specifically, the first critical speed may be mathematically represented as:

$$\text{critical speed} = \sqrt{\frac{k^2}{w}},$$

wherein k represents the stiffness of the rotor and w represents the weight of the rotor. As such, an increase in the weight of the rotor results in a lower critical speed. At critical speed, because the rotor rotates at a frequency that is generally equal to the natural frequency of the rotor, rotor vibration may become unstable. To avoid damage to the rotor and/or engine, the rotor must either be operated at a speed that is less than the first critical speed, or the rotor must be quickly accelerated to an operating speed that is faster than the first critical speed.

Other known rotors are designed to have less weight, such that the first critical speed is increased. At least some of such rotors include a bore that extends substantially concentrically through the rotor shaft. However, to satisfy structural requirements such known rotors are generally fabricated with a large wall thickness as measured between the outer bore diameter and the outer rotor diameter. As such, the solidity of such rotors is generally not reduced enough to enable the rotor to be operated at a speed that is less than the first critical speed.

BRIEF DESCRIPTION OF THE INVENTION

In one aspect, a method of fabricating a turbine rotor is provided. The method includes fabricating a plurality of substantially cylindrical disks. Fabricating each disk includes fabricating a substantially cylindrical body and extending a bore substantially concentrically through the body. The method also includes coupling at least two of the plurality of disks together to form a rotor having a bore extending axially therethrough.

In another aspect, a rotor for a turbine is provided. The rotor includes a plurality of substantially cylindrical disks. Each disk includes a substantially cylindrical body having a bore extending substantially concentrically therethrough. The rotor also includes at least two of the disks coupled together such that the bore extends generally axially through the rotor.

In a further aspect, a turbine engine is provided. The turbine engine includes a turbine and a rotor extending axially through the turbine. The rotor includes a plurality of substantially cylindrical disks. Each disk includes a substantially cylindrical body having a bore extending substantially concentrically therethrough. The rotor also includes at least two of the disks coupled together such that the bore extends generally axially through the rotor.

DETAILED DESCRIPTION OF THE INVENTION

Figure 1:
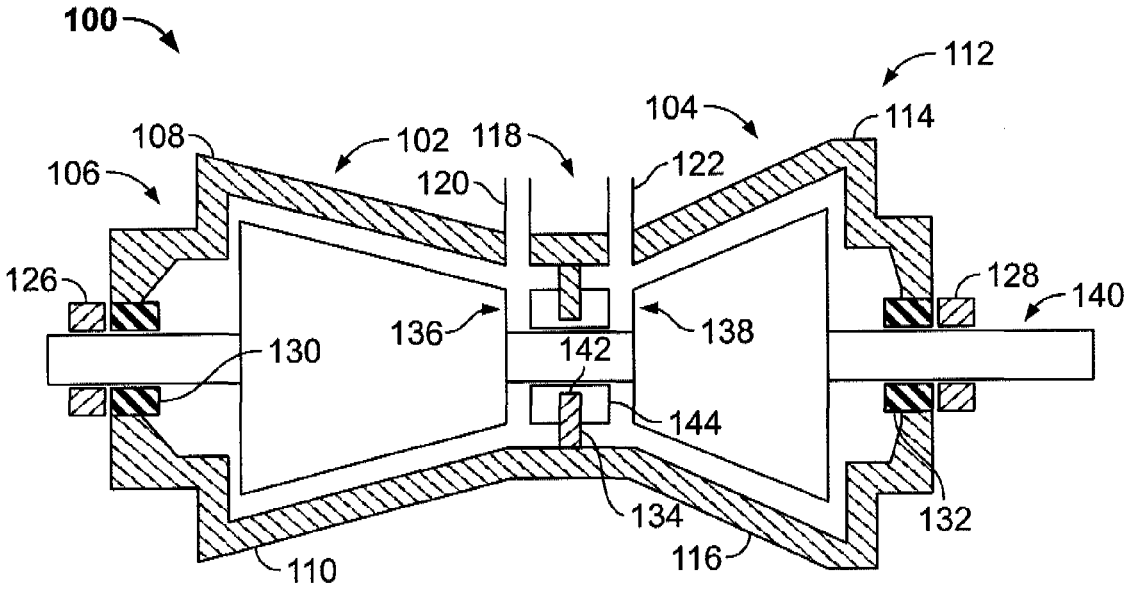
FIG. 1 is a cross-sectional schematic view of an exemplary opposed-flow steam turbine engine.

FIG. 1 is a cross-sectional schematic illustration of an exemplary opposed-flow steam turbine engine 100 including a high pressure (HP) section 102 and an intermediate pressure (IP) section 104. An HP shell, or casing, 106 is divided axially into upper and lower half sections 108 and 110, respectively. Similarly, an IP shell 112 is divided axially into upper and lower half sections 114 and 116, respectively. In the exemplary embodiment, shells 106 and 112 are inner casings. Alternatively, shells 106 and 112 are outer casings. A central section 118 positioned between HP section 102 and IP section 104 includes a high pressure steam inlet 120 and an intermediate pressure steam inlet 122. Within casings 106 and 112, HP section 102 and IP section 104, respectively, are arranged in a single bearing span supported by journal bearings 126 and 128. Steam seal apparatus 130 and 132 are located inboard of each journal bearing 126 and 128, respectively. In the exemplary embodiment, shells 106 and 112 are outer casings. Alternatively, shells 106 and 112 are inner casings.

An annular section divider 134 extends radially inwardly from central section 118 towards a rotor shaft 140 that extends between HP section 102 and IP section 104. More specifically, divider 134 extends circumferentially around a portion of rotor shaft 140 between a first HP section inlet nozzle 136 and a first IP section inlet nozzle 138. Divider 134 is received in a channel 142 defined in a packing casing 144. More specifically, channel 142 is a C-shaped channel that extends radially into packing casing 144 and around an outer circumference of packing casing 144, such that a center opening of channel 142 faces radially outwardly.

During operation, high pressure steam inlet 120 receives high pressure/high temperature steam from a steam source, for example, a power boiler (not shown in FIG. 1). Steam is routed through HP section 102 from inlet nozzle 136 wherein work is extracted from the steam to rotate rotor shaft 140 via a plurality of turbine blades, or buckets (not shown in FIG. 1) that are coupled to shaft 140. Each set of buckets includes a corresponding stator assembly (not shown in FIG. 1) that facilitates routing of steam to the associated buckets. The steam exits HP section 102 and is returned to the boiler wherein it is reheated. Reheated steam is then routed to intermediate pressure steam inlet 122 and returned to IP section 104 via inlet nozzle 138 at a reduced pressure than steam entering HP section 102, but at a temperature that is approximately equal to the temperature of steam entering HP section 102. Work is extracted from the steam in IP section 104 in a manner substantially similar to that used for HP section 102 via a system of rotating and stationary components. Accordingly, an operating pressure within HP section 102 is higher than an operating pressure within IP section 104, such that steam within HP section 102 tends to flow towards IP section 104 through leakage paths that may develop between HP section 102 and IP section 104.

In the exemplary embodiment, steam turbine 100 is an opposed-flow high pressure and intermediate pressure steam turbine combination. Alternatively, steam turbine 100 may be used with any individual turbine including, but not being limited to low pressure turbines. In addition, the present invention is not limited to being used with opposed-flow steam turbines, but rather may be used with steam turbine configurations that include, but are not limited to, single-flow and double-flow turbine steam turbines. Moreover, the present invention is not limited to steam turbines, but rather may be used with gas turbine engines.

Figure 2:
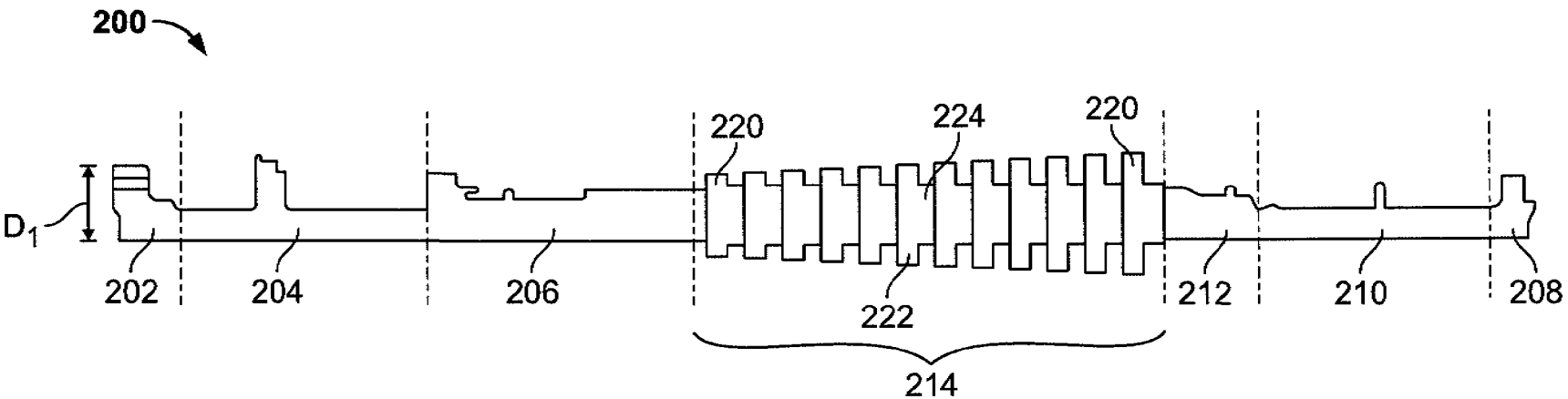
FIG. 2 is a schematic view of an exemplary rotor that may be used with the steam turbine shown in FIG. 1.

FIG. 2 is a schematic view of an exemplary rotor 200 that may be used with steam turbine 100 (shown in FIG. 1). Specifically, in the exemplary embodiment, rotor 200 is that portion of rotor 140 (shown in FIG. 1) that extends through turbine IP section 104. In the exemplary embodiment, a similar rotor portion extends from rotor 200 through HP section 102. In an alternative embodiment, rotor 200 is independently used with a single-flow steam turbine. In another alternative embodiment, rotor 200 is used with a double-flow steam turbine. Rotor 200 includes a first end section 202 that is coupled to a first bearing section 204 and a second end section 208 that is coupled to a second bearing section 210. The first bearing section 204 extends between first end section 202 and first packing section 206. The second bearing section 210 extends between second end section 208 and second packing section 212. A steampath section 214 extends between first packing section 206 and second packing section 212.

In the exemplary embodiment, first end section 202, first bearing section 204, and first packing section 206 are forged from a single piece of steel alloy or any other material suitable for use in a steam turbine. In an alternative embodiment, first end section 202, first bearing section 204, and first packing section 206 are individually forged and coupled together using any suitable coupling method such as, but not limited to, bolting, threading, welding, brazing, friction fitting, and/or shrink fitting. Similarly, in the exemplary embodiment, second end section 208, second bearing section 210, and second packing section 212 are forged from a single piece of steel alloy or any other material suitable for use in a steam turbine. In an alternative embodiment, second end section 208, second bearing section 210, and second packing section 212 are individually forged and coupled together using any suitable coupling method such as, but not limited to, bolting, threading, welding, brazing, friction fitting, and/or shrink fitting. Moreover, in the exemplary embodiment, steampath section 214 is coupled to first packing section 206 and second packing section 212 using any suitable coupling method such as, but not limited to, bolting, threading, welding, brazing, friction fitting, and/or shrink fitting.

Steampath section 214 includes a plurality of circumferential disks 220 coupled together. Disks 220 are individually forged from a steel alloy or any other material suitable for use in a turbine. In the exemplary embodiment twelve disks 220 are illustrated. However, in alternative embodiments, steampath section 214 includes any suitable numbers of disks 220. Specifically, in the exemplary embodiment, each disk 220 represents a stage of steampath section 214. In an alternative embodiment, each stage of steampath section 214 includes a group of disks 220. In such an embodiment, each group of disks 220 includes any suitable number of disks 220. Each disk 220 includes an upstream member 222 and a downstream member 224. Specifically upstream member 222 includes a plurality of airfoils (not shown) and downstream member 224 provides a space between the airfoils through which a stator assembly extends.

In the exemplary embodiment, the downstream member 224 of each disk 220 is coupled against an upstream member 222 of an adjacent disk 220. In an alternative embodiment, at least one of a circumferential seal, a circumferential spacer, and/or a balance wheel is coupled between member 222 and the adjacent disk 220. Alternatively, balance wheels may be coupled to any portion of rotor 200. Moreover, in the exemplary embodiment, each subsequent disk 220 has a greater circumference than the disk 220 positioned immediately upstream. In an alternative embodiment, disks 220 each have substantially the same diameter $D_1$. In an embodiment, wherein the disks 220 are grouped together in stages, each disk 220 within a respective stage has approximately the same diameter $D_1$ and each subsequent stage of disks 220 has a greater diameter $D_1$ than the disks 220 within the stage immediately upstream.

Figure 4:
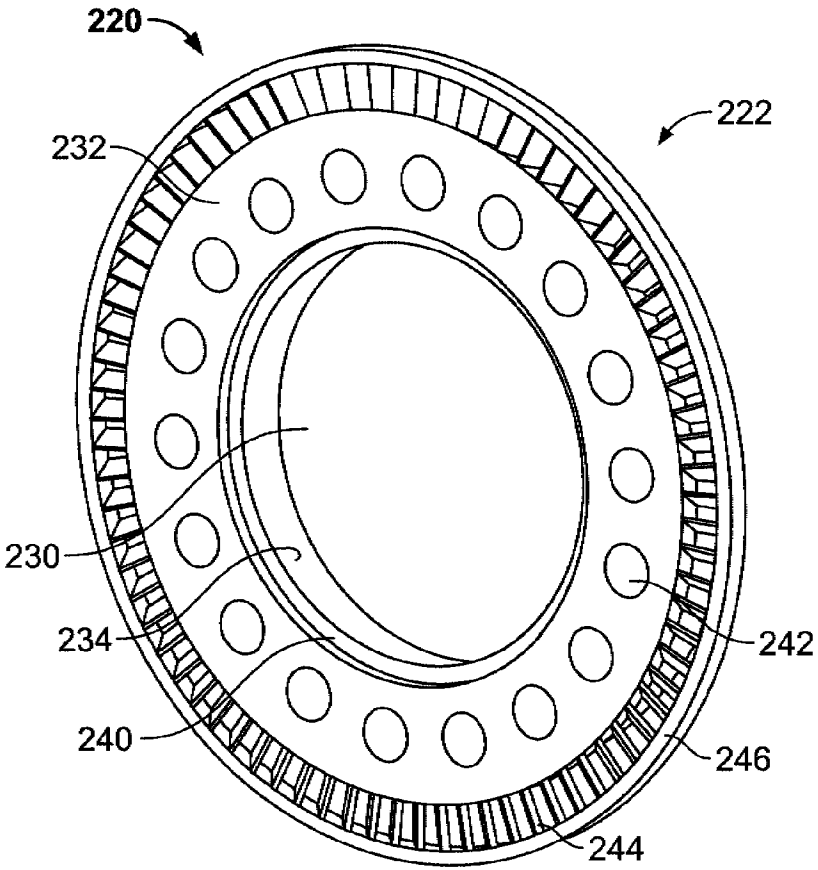
FIG. 4 is a rear perspective view of the portion of the rotor shown in FIG. 3.
Figure 3:
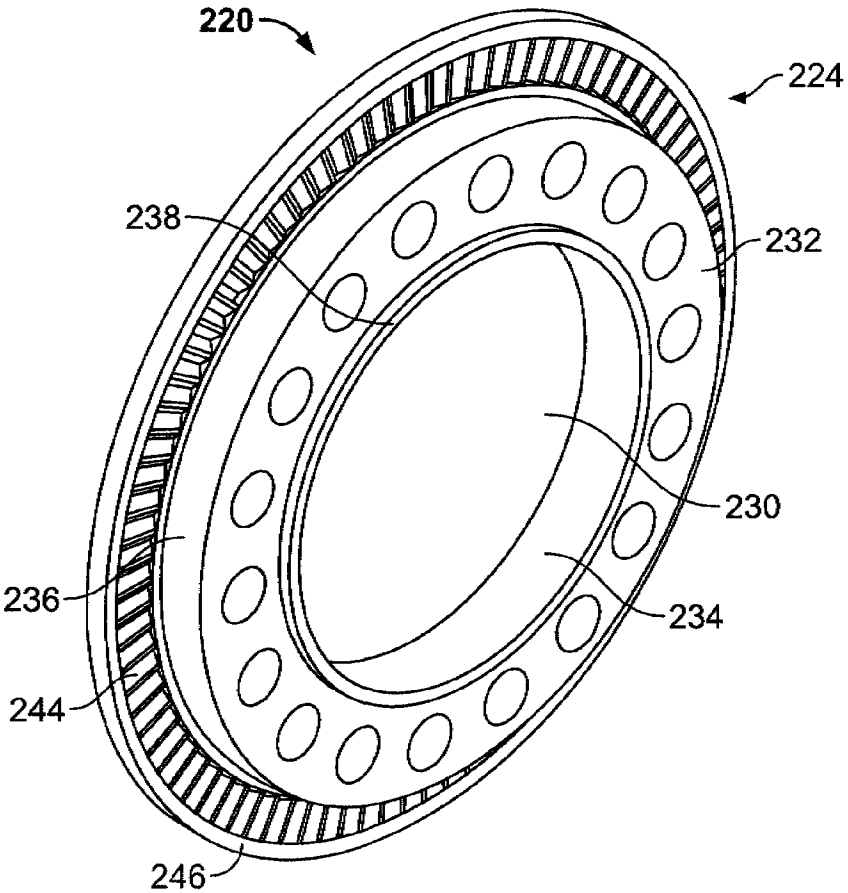
FIG. 3 is a forward perspective view of a portion of the rotor shown in FIG. 2.

FIG. 3 is a forward perspective view of a disk 220. FIG. 4 is a rear perspective view of the disk 220. Specifically, FIG. 3 is a view of downstream end 224, and FIG. 4 is a view of upstream end 222. Disk 220 is substantially circumferential and includes a bore 230 that extends substantially axially therethrough such that a disk body 232 extends radially outwardly from bore 230. Specifically, body 232 extends from a radially inner edge 234 to a radially outer edge 236. In the exemplary embodiment, each disk body 232 is configured to couple to an adjacent disk body 232 such that bore 230 extends through a full length of steampath section 214. In the exemplary embodiment, a downstream end 224 of radially inner edge 234 includes a projection 238 that extends generally axially therefrom and substantially circumferentially around body 232. Further, in the exemplary embodiment, an upstream end 222 of radially inner edge 234 includes a notch 240 that extends substantially circumferentially around body 232. In the exemplary embodiment, projection 238 is sized to be received within a notch 240 defined in an adjacent disk 220 such that each disk 220 is substantially concentrically aligned. In an alternative embodiment, projection 238 is sized to be received within a notch formed in at least one of a circumferential seal, a circumferential spacer, and/or a balance wheel.

Disk body 232 also includes a plurality of apertures 242 spaced circumferentially and extending therethrough. In the exemplary embodiment, disk body 232 includes eighteen apertures 242. Alternatively disk body 232 may include any suitable number of apertures 242. Apertures 242 of each adjacent disk 220 are substantially concentrically aligned to facilitate disks 220 being coupled together. Specifically, disks 220 are coupled using at least one of an axial bolt, a stud, a threaded rod, or any other suitable coupling mechanism extending through each aperture 242. Alternatively, disks 220 are coupled via at least one of a weld process, a braze process, or any other suitable retention process.

A plurality of airfoils 244 coupled at disk upstream end 222 extend radially outwardly from body 232. Airfoils 244 are oriented such that, when disks 220 are coupled together, a gap is defined at downstream end 224 between the plurality of airfoils 244 of each adjacent disk 220. Moreover, the gap enables a stator assembly to be extended therethrough. In the exemplary embodiment, airfoils 244 are fabricated unitarily with body 232. In an alternative embodiment, body 232 includes a plurality of dovetail slots that are each sized to receive and retain an airfoil 244. Furthermore, in the exemplary embodiment, disk 220 includes an integral seal tip 246 that is coupled to each airfoil 244 and extends around disk 220. In an alternative embodiment, seal tip 246 is fabricated from a plurality of sections coupled together to form a unitary circumferential seal tip. In another alternative embodiment, disk 220 does not include seal tip 246.

During fabrication of rotor 200, disks 220 are coupled together, as described above, to provide a rotor 200 having a generally concentric bore 230 extending therethrough. In the exemplary embodiment, bore 230 extends through steampath section 214. In an alternative embodiment, the other sections of rotor 200 are fabricated such that bore 230 extends substantially through a full length of rotor 200. Bore 230 reduces the weight of rotor 200, such that, during operation of turbine 100, the first critical speed is increased. As such, turbine 100 is operable under normal operating conditions without reaching the first critical speed. As such, vibrations within turbine 100 are facilitated to be reduced. Moreover, bore 230 facilitates reducing maintenance associated turbine 100, while improving turbine efficiency and life span.

Furthermore, bore 230 substantially reduces costs associated with a turbine rotor. Specifically, the design of disk 220 reduces manufacturing costs and the cost of support equipment associated with known rotors that have operating speeds that require the rotor to pass through the first critical speed. Furthermore, the design of rotor 200 facilitates reducing the weight and size of the rotor such that time and costs associated with forging the rotor are reduced. Moreover, the reduction of rotor size and weight increases the number of material vendors available for fabrication of the rotor. In addition, the design of rotor 200 reduces an amount unused and wasted rotor forging and bucket materials.

In the exemplary embodiment, a method of fabricating a turbine rotor is provided. The method includes fabricating a plurality of substantially cylindrical disks. Fabricating each disk includes fabricating a substantially cylindrical body and extending a bore substantially concentrically through the body. The method also includes coupling at least two of the plurality of disks together to form a rotor having a bore extending axially therethrough.

As used herein, an element or step recited in the singular and proceeded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

Although the apparatus and methods described herein are described in the context of fabricating a rotor for a steam turbine, it is understood that the apparatus and methods are not limited to rotors or steam turbines. Likewise, the rotor components illustrated are not limited to the specific embodiments described herein, but rather, components of rotor can be utilized independently and separately from other components described herein.

While the invention has been described in terms of various specific embodiments, those skilled in the art will recognize that the invention can be practiced with modification within the spirit and scope of the claims.

What is claimed is:

1. A method of assembling a turbine rotor for use with a turbine system, said method comprising:

fabricating a plurality of substantially cylindrical disks, wherein each disk includes a substantially cylindrical body having a radially inner edge and a radially outer edge, wherein the inner edge includes an upstream end that includes a notch, and a downstream end that includes a projection, the inner edge defining a bore that extends substantially concentrically through the body, wherein a diameter of the bore is selected to enable the turbine system to operate without reaching a first critical speed of the turbine rotor; and coupling at least two of the plurality of disks together to form a rotor, wherein a first disk is coupled to a second disk as a first disk projection is received within a second disk notch.

2. A method in accordance with claim 1 wherein said coupling at least two of the plurality of disks together further comprises coupling the disks together with a rabbeted fit.

3. A method in accordance with claim 1 further comprising:

forming a plurality of apertures that are spaced circumferentially around the body of each disk; and extending a plurality of coupling devices through the plurality of apertures to couple the disks together.

4. A method in accordance with claim 1 further comprising coupling at least one of a circumferential seal, a circumferential spacer, and a balance wheel between the at least two adjacent disks being coupled together.

5. A method in accordance with claim 1 further comprising spacing a plurality of airfoils circumferentially around the body such that the plurality of airfoils extend radially outwardly from the body.

6. A method in accordance with claim 5 further comprising positioning the plurality of airfoils of each disk such that a gap is defined between the adjacent disks coupled together.

7. A method in accordance with claim 5 wherein spacing a plurality of airfoils circumferentially around the body further comprises forming a plurality of dovetails slots in the body; and inserting each of the plurality of airfoils within one of the plurality of dovetail slots.

8. A rotor for use with a turbine, said rotor comprising a plurality of substantially cylindrical disks, each disk comprising a substantially cylindrical body that has a radially inner edge and a radially outer edge, said inner edge defining a bore that extends substantially concentrically through said body, wherein a diameter of the bore is selected to enable said turbine to operate without reaching a first critical speed of said rotor, said inner edge comprising an upstream end that comprises a notch and a downstream end that comprises a projection, wherein a first disk of said plurality of disks is coupled to a second disk of said plurality of disks such that the bore extends generally axially through said rotor, and wherein said first disk is coupled to said second disk as said first disk projection is received within said second disk notch.

9. A rotor in accordance with claim 8 wherein each said disk further comprises a rabbet to couple said plurality of disks.

10. A rotor in accordance with claim 8 further comprising:

a plurality of apertures defined circumferentially around said body of each said disk; and a plurality of coupling devices extending through said plurality of apertures to couple said first disk to said second disk.

11. A rotor in accordance with claim 10 further comprising at least one of a circumferential seal, a circumferential spacer, and a balance wheel coupled between said first disk and said second disk.

12. A rotor in accordance with claim 8 wherein each said disk further comprises a plurality of airfoils spaced circumferentially around said body, each of said airfoils extending radially outwardly from said body.

13. A rotor in accordance with claim 12 wherein said plurality of airfoils are each oriented such that a gap is defined between said first disk and said second disk.

14. A rotor in accordance with claim 12 further comprising a plurality of dovetail slots formed in said body, each of said plurality of airfoils is coupled within one of said plurality of dovetail slots.

15. A turbine engine comprising:

a turbine; and a rotor extending axially through said turbine, said rotor comprising a plurality of substantially cylindrical disks, each disk comprising a substantially cylindrical body that has a radially inner edge and a radially outer edge, said inner edge defining a bore that extends substantially concentrically through said body, wherein a diameter of the bore is selected to enable said turbine to operate without reaching a first critical speed of said rotor, said inner edge comprising an upstream end that comprises a notch and a downstream end that comprises a projection, wherein a first disk of said plurality of disks is coupled to a second disk of said plurality of disks such that the bore extends generally axially through said rotor, and wherein said first disk is coupled to said second disk as said first disk projection is received within said second disk notch.

16. A turbine engine in accordance with claim 15 wherein each said disk further comprises a rabbet to couple said plurality of disks.

17. A turbine engine in accordance with claim 15 further comprising:

a plurality of apertures defined circumferentially around said body of each said disk; and a plurality of coupling devices extending through said plurality of apertures to couple said first disk to said second disk.

18. A turbine engine in accordance with claim 15 wherein each said disk further comprises a plurality of airfoils spaced circumferentially around said body, each of said airfoils extending radially outwardly from said body.

19. A turbine engine in accordance with claim 18 wherein said plurality of airfoils are each oriented such that a gap is defined between said first disk and said second disk.

20. A turbine engine in accordance with claim 18 wherein said rotor further comprises a plurality of dovetail slots formed in the body, each of said plurality of airfoils is coupled within one of said plurality of dovetail slots.

* * * * *